United States Patent [19]

Schuplin

[11] 4,041,657

[45] Aug. 16, 1977

[54] FIXTURE SUPPORT FOR GRID TYPE CEILING

[75] Inventor: Jerome T. Schuplin, Parma Heights, Ohio

[73] Assignee: Fastway Fasteners, Inc., Lorain, Ohio

[21] Appl. No.: 614,690

[22] Filed: Sept. 18, 1975

[51] Int. Cl.[2] ..... E04B 5/52

[52] U.S. Cl. ..... 52/39; 52/28; 248/343

[58] Field of Search ..... 52/39, 28, 29, 665, 52/760; 248/214, 228, 342, 343

[56] References Cited

U.S. PATENT DOCUMENTS

| | | | |
|---|---|---|---|
| 2,854,205 | 9/1958 | Kruger | 248/343 |
| 3,081,398 | 3/1963 | Karth | 248/343 |
| 3,121,259 | 2/1964 | Versen | 52/28 |
| 3,149,814 | 9/1964 | McGinty | 248/343 |
| 3,233,297 | 2/1966 | Havener | 52/760 |
| 3,352,071 | 11/1967 | Sutter | 52/28 |
| 3,390,856 | 7/1968 | Van Buren | 52/760 |
| 3,586,282 | 6/1971 | Freeman | 52/28 |
| 3,597,889 | 8/1971 | Nigro | 248/343 |
| 3,606,224 | 9/1971 | Gatheim | 52/760 |
| 3,700,885 | 10/1972 | Bobrick | 248/343 |

FOREIGN PATENT DOCUMENTS

| | | | |
|---|---|---|---|
| 37,287 | 3/1969 | Finland | 52/28 |
| 1,158,145 | 9/1962 | Germany | 248/228 |
| 391,985 | 9/1965 | Switzerland | 248/214 |

*Primary Examiner*—Price C. Faw, Jr.
*Assistant Examiner*—Henry Raduazo
*Attorney, Agent, or Firm*—Baldwin, Egan, Walling & Fetzer

[57] ABSTRACT

A fixture support for a grid-type ceiling, comprising spaced clip means adapted for mounting on spaced, generally parallel, inverted T-shaped, in cross section, grid bars, with the clips having a plurality of vertically spaced openings therein for mounting a bridging bar therebetween, the bridging bar having hanger means mounted thereon for suspending a fixture, such as an electrical outlet box therefrom, and with the vertically spaced openings on the clip providing for selective vertical positioning of the bridging bar and associated hanger means with respect to the clips, thereby varying the vertical position of the outlet box with respect to the ceiling grid.

20 Claims, 14 Drawing Figures

FIXTURE SUPPORT FOR GRID TYPE CEILING

This invention relates to a support assembly for installing fixtures such as electrical outlet boxes or the like between a pair of spaced ceiling grid members, such as for instance inverted T-shaped in cross section, grid bars, and more particularly relates to a support assembly which includes clip means which is adapted to clasp the respective ceiling grid member, and having means for mounting a bridging bar therebetween, with the mounting means including means for varying the vertical position of the bridging bar, and thus the vertical position of the box or fixture, with respect to the clips.

BACKGROUND OF THE INVENTION

Various support arrangements for installing fixtures such as electrical outlet boxes or the like, between a pair of celing grid members are known in the art. U.S. Pat. Nos. 3,329,387, issued July 4, 1967, to H. G. Fischer; 3,352,071, issued Nov. 14, 1967, to O. S. Sutter; 3,371,900, issued Mar. 5, 1968, to A. F. Jacobs; 3,597,889, issued Aug. 10, 1971, to Antonio Migro, and 3,397,789, issued Mar. 19, 1974, to Kenneth L. Wasson, are examples of prior art arrangements for suspending a fixture or outlet box to an inverted T-bar grid type of ceiling structure.

These arrangements however have not been entirely satisfactory due in part to the necessity of stocking a plurality of arrangements for enabling the varying of the vertical positioning of a fixture with respect to the grid ceiling, as well as generally requiring undue time and effort to fixedly position the fixture with respect to the bridging bar.

SUMMARY OF THE INVENTION

The present invention provides a novel support for a fixture such as an electrical outlet box or similar item, for mounting on spaced elements of a grid type ceiling structure, and which can be rapidly mounted on the respective grid elements with a bridging bar extending therebetween, and which can be rapidly adjusted vertically as well as lengthwise of the bridging bar, so to expeditiously position the outlet box or fixture with respect to the ceiling, and which is adaptable for ready use in varying situations, so as to decrease the necessity of providing specialized supports for each different mounting situation encountered.

Accordingly, an object of the invention is to provide a novel fixture support assembly for a grid type ceiling structure, which assembly expedites the mounting of a fixture in secured relation with respect to the ceiling.

Another object of this invention is to provide a support of the latter mentioned type which includes clip means formed of yieldable material, and which also includes means for clasping the clip to a respective inverted T bar ceiling grid element, and wherein means are provided for selectively adjusting the vertical position of a bridging bar with respect to the clips, the latter means comprising vertically spaced openings in the clips for selectively mounting the bridging bar therein.

Another object of the invention is to provide a support arrangement of the latter type wherein the vertically spaced openings are adapted for receiving various types of bridging bars, both the horizontal web type and the vertical web type.

A still further object of the invention is to provide a support arrangement of the above type wherein the end clips include generally vertical slot means disposed generally adjacent the lower extremity thereof and communicating with the exterior of the clip for receiving the stem of the respective T bar in the slot means, and with there being provided resilient tongue means disposed adjacent the lower extremity of the respective clip and coacting with the slot means for releasably clasping the T bar, thus removably retaining the clips to the respective T bar.

A still further object of the invention is to provide a clip means for use in a fixture support arrangement of the above general type, wherein the clip means are of generally U-shaped configuration in plan, with the arms of the U having the slots therein for receiving the respective T bar, for mounting the clip means on the respective T bar; and with the base portion of the U having the vertically spaced openings therein for supporting the bridging bar.

Other objects and advantages of the invention will be apparent from the following description taken in conjunction with the accompanying drawings, wherein:

DESCRIPTION OF THE PREFERRED EMBODIMENTS

Referring now to FIGS. 1 through 5, there is illustrated a support assembly for mounting electrical outlet boxes B on a suspended grid type ceiling C, which includes spaced generally parallel extending grid elements 10 of the inverted T type, well known in the art.

Figure 5:
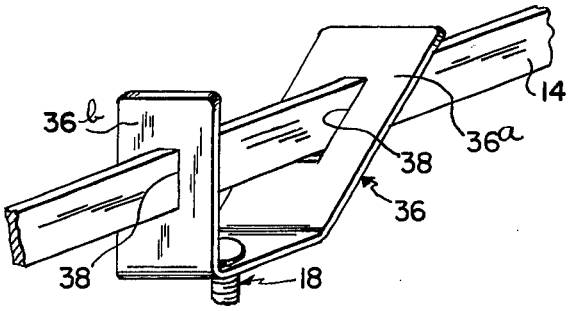
FIG. 5 is an enlarged fragmentary view showing a hanger bracket for suspending an outlet box on a bridging bar.

In the embodiment illustrated elements 10 include a bulbous-like stem 11 and a flanged base 11*a* on which the ceiling tile elements T are adapted to rest. The support assembly includes end clip members 12 adapted for mounting on respective grid elements 10, and supporting therebetween a bridging bar 14. Supported by the bridging bar 14 is a hanger bracket 36, which is adapted to suspend the outlet box B therefrom, and as by means of the associated fastener 18 (FIG. 5). Fastener bolt 18 is adapted to extend through an opening in the outlet box, and suspend the latter from the assembly in conjunction with a nut coacting with the threaded shank of the fastener and with the underside of the box.

Each of the end clips 12 are preferably formed from material having a certain amount of flexibility, such as for instance, sheet metal or plastic. Clips 12 are preferably of generally U-shaped configuration in plan, as can be best seen in FIG. 4, comprising arm portions 19 and a base portion 20.

Each of the arm portions has a slot 22 formed therein commencing adjacent the bottom extremity thereof, and extending generally vertically, with the slots 22 in the arm portions of the respective clip generally aligned, for receiving the stem 11 of the respective inverted T grid element 10.

A clasping means in the form illustrated of a resilient, generally curved tongue 26, extends downwardly and inwardly from the base portion 20, and is adapted to coact with the slots 22, to releasably retain the clip to the respective T bar. The tongue 26 is preferably formed from the material of the clip proper and has a rounded hook-like end portion 26*a* which is adapted for sliding coaction with the stem 11 of the T bar, for facilitating the movement of the clip down onto the T bar, while receiving the stem of the grid element in the slots 22. Also, each of the arm portions 19 of the clip preferably include a foot section 28 adjacent the bottom extremity of the associated slot 22, for facilitating the hooking of the clip onto the T bar stem. The tongue is adapted for engagement with the stem section as illustrated in dottled lines in FIG. 2, when gripping the associated T bar. Such an arrangement facilitates the mounting of the clip on its associated T bar merely by pushing down on the top of the clip, whereupon the resilient tongue 26 is forced outwardly to permit the stem 11 of the T bar to pass into the slot 22, whereupon the memory of the material of the tongue moves it inwardly once the widened portion of the stem is passed, to positively grip the T bar.

The base portion 20 of the clip is provided with a plurality of vertically spaced openings 30, 30*a*, and 30*b* therein, which openings are adapted for mounting a respective end of the bridging bar 14, for positioning the bridging bar between the generally parallel extending grid elements 10. Openings 30, 30*a* are adapted to receive a vertical web type bridging bar of the type shown for instance in FIG. 5, while the bottom opening 30*b* is adapted to receive a horizontal web type bridging bar of the type illustrated, for instance, in FIG. 6.

Preferably the arm portions 19 of the respective clip are provided with inwardly extending retainer tabs 32 (FIGS. 3 and 4) formed from partially severed sections of the material of the clip, and bent inwardly into a generally accurate configuration as shown, for yieldingly gripping the associated bridging bar received in opening 30 or 30*a*, and prevent or resist its inadvertent withdrawal movement out of coaction with the associated end clip. The latter described configuration of the retainer tabs ensures that the bridging bar can be readily inserted into the respective opening 30, 30*a* with the tab 32 projecting into the space adjacent the openings (FIG. 3) so as to yieldably clasp the bridging bar.

Mounted on the bridging bar 14 is a hanger bracket 36 which in the embodiment illustrated is of generally non-symmetrical U-shape in side elevation, and which has openings 38 in the arm portions, which receive therethrough the respective bridging bar 14.

Bracket 36 is preferably generally resilient so that when installing the bracket on the bridging bar, the diagonal arm 36*a* is forced toward the other arm 36*b* by the workman to generally align the openings 38 for insertion of the bridging bar. Upon release, the arm 36*a* springs outwardly to diagonal position and grips the bridging bar, and prevents ready sliding movement of the associated electrical outlet box lengthwise of the bridging bar. To position the box with respect to the bridging bar it is merely necessary to move the arm portion 36*a* inwardly toward the other arm portion thereby releasing the gripping coaction of the arms with the associated bridging bar. The bracket 36 may be formed of sheet metal and the threaded fastener 18 which is adapted to extend through the top of the outlet box, may be loosely received in coaction with the bracket, or may be fixed with respect to the bracket, for suspending the box B on the bridging bar.

Figure 1:
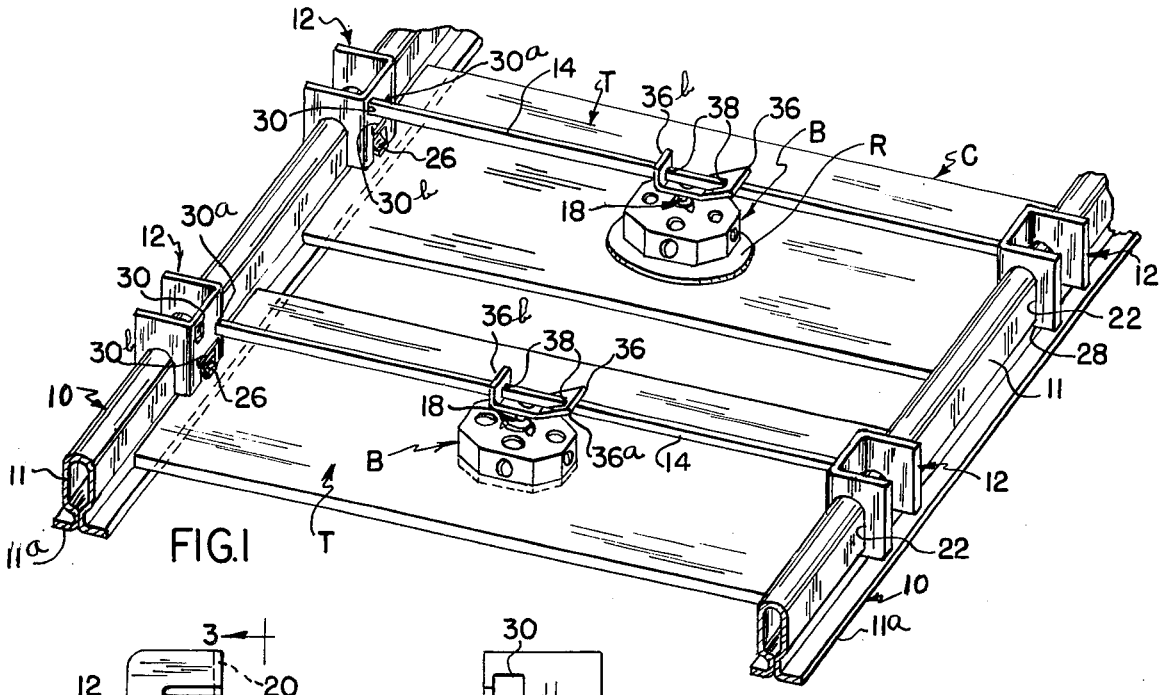
FIG. 1 is a perspective view illustrating a support arrangement of the invention mounting associated electrical outlet boxes thereon.
Figure 2:
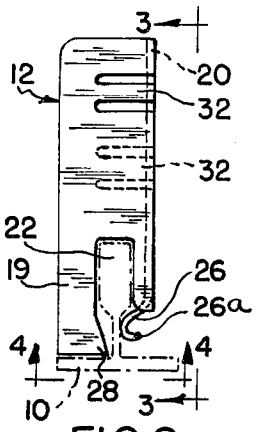
FIG. 2 is an enlarged side elevational view of one of the clip members illustrated in FIG. 1.
Figure 3:
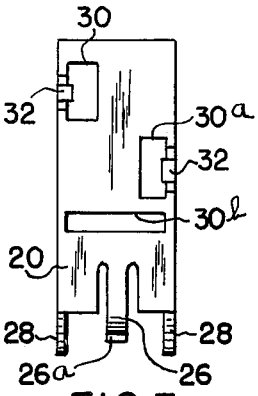
FIG. 3 is an elevational view taken generally along the plane of line 3—3 of FIG. 2, looking in the direction of the arrows.
Figure 4:
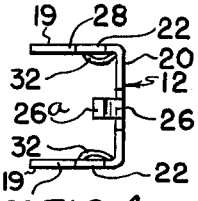
FIG. 4 is a plan view taken generally along the plane of line 4—4 of FIG. 2 looking in the direction of the arrows.

As can be seen in FIG. 1, by properly positioning the ends of the bridging bar 14 in the selected set of the opening 30, 30*a*, the vertical position of an outlet box B can be varied with respect to the clips and with respect to the ceiling tiles T. In the other position of the box as shown at the upper portion of FIG. 1, a plaster ring R can be utilized with the box to finish the ceiling, and in the conventional manner.

Figure 6:
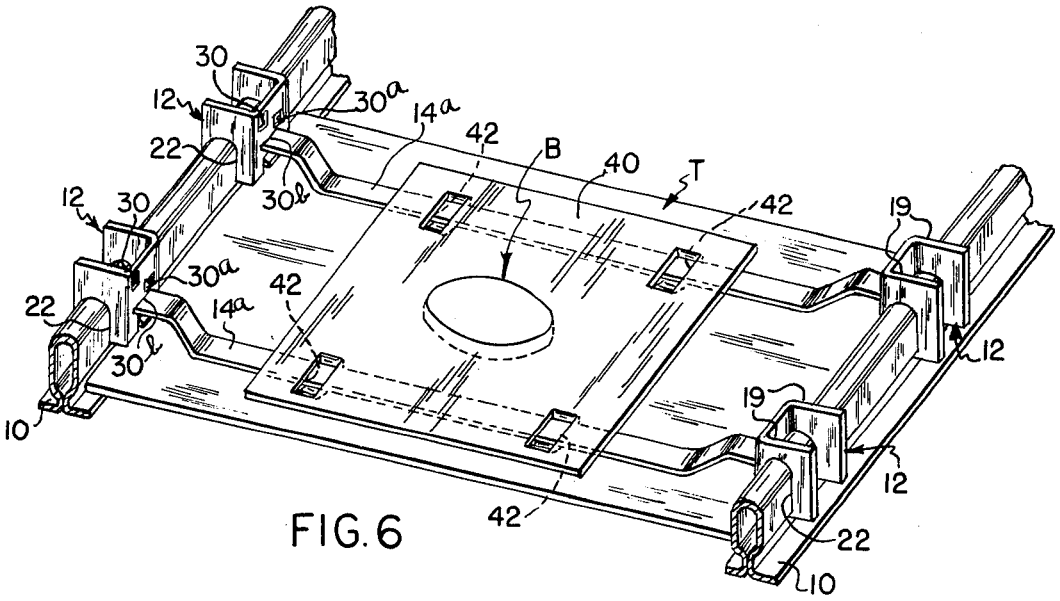
FIG. 6 is a generally perspective view, illustrating a modified arrangement of the support assembly.

Referring now to FIG. 6, there is shown a further embodiment of assembly wherein the outlet box B includes a generally flat plate-like member 40 in which openings 42 are provided by deforming partially severed bendable tab portions of the plate out of the plane thereof, providing hanger means for receiving the bridging bars 14*a*, and making it possible to slide the plate and associated box horizontally on the bridging bars 14*a*.

Bridging bars 14*a* in the embodiment illustrated are of the horizontal web type, and are received in the opening 30*b* of the respective end clip 12, to mount the bridging bars between the grid elements 10. The bridging bars in this embodiment have a depressed central portion which lowers the position of the bars, of the outlet box, and of the associated plate 40, with respect to the clips.

Figure 7:
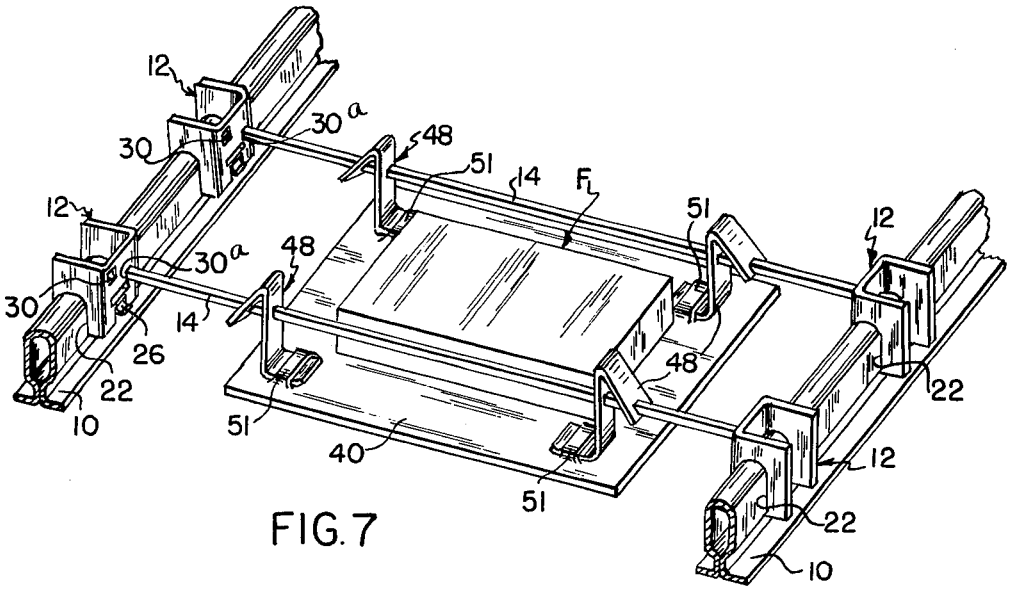
FIG. 7 is a view similar to FIG. 6, showing a further embodiment of support assembly.
Figure 8:
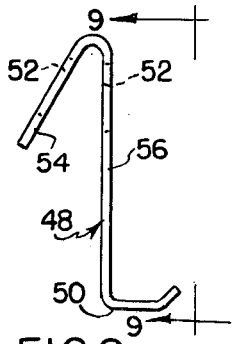
FIG. 8 is an enlarged, elevational view, of one of the hanger brackets utilized in the assembly of FIG. 7.
Figure 9:
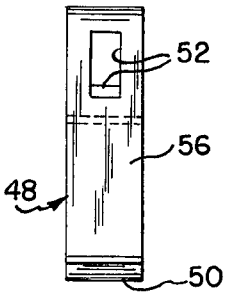
FIG. 9 is an elevational view taken generally along the plane of line 9—9 of FIG. 8, looking in the direction of the arrows.

Referring now to FIG. 7 through 9, there is shown a further embodiment wherein the fixture F is supported by hangers 48 which are mounted on the bridging bars 14 of the generally vertical web type of FIGS. 1 through 5, with the bridging bars being received, in the embodiment illustrated, in lower opening 30*a* of the respective clip 12, for mounting the bridging bars 14 in bridging relation between the generally parallel extending grid elements 10.

The hangers 48 have a generally hook-shaped base portion 50, which is received in a partially severed strap 51 bent out of the plane of the associated plate 40 of the fixture F. The upper portion of the respective hanger 48 has openings 52 therein, through which the respective bridging bar 14 passes. Diagonal arm portion 54 of the hanger is adapted to be squeezed so as to more or less align the opening 52 therein with the corresponding opening in vertical web portion 56 of the hanger, so that the bridging bar can be readily inserted through such openings, and when released, portion 54 springs back toward its original non-stressed condition to lock or clasp the associated bridging bar and prevent free movement of the hanger lengthwise along the bar. In the embodiment illustrated, two bridging bars and four hangers are utilized to mount the fixture F on the grid ceiling structure 10.

Figure 10:
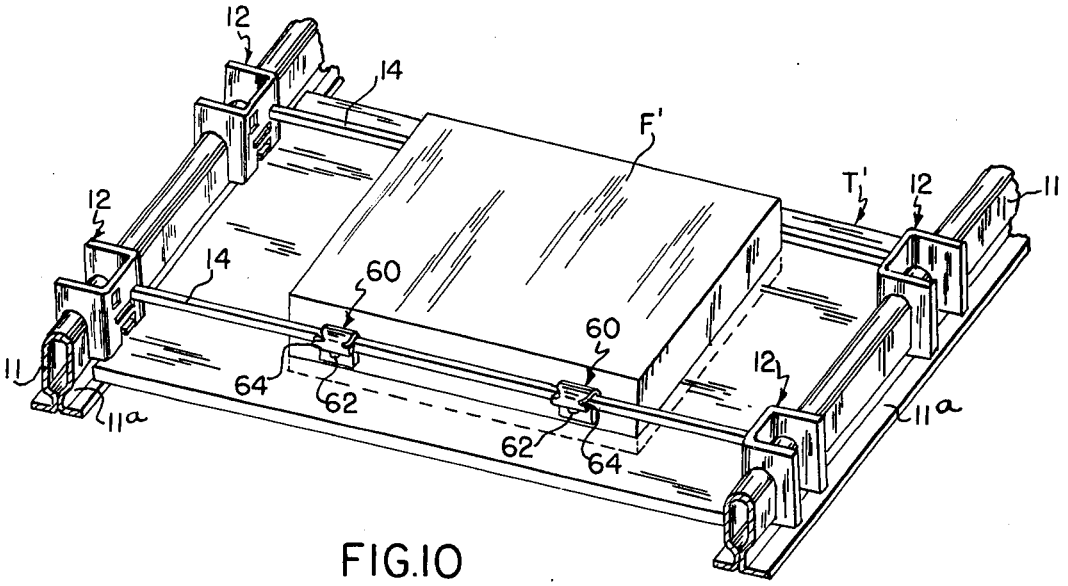
FIG. 10 is a perspective view illustrating a further embodiment of support assembly.

Referring now to FIG. 10, there is shown a further embodiment of assembly wherein the fixture F′ is mounted on the bridging bars 14 as by means of hanger clips 60 which are attached, as by fasteners, such as rivets or a threaded fastener 62, to the sides of the fixture F′. The outer sides of the hanger clip 60 are provided with partially severed bendable barbs 64 which may be deformed into clasping coaction with the respective bridging bar, so as to lock the fixture F′ in selected lengthwise positional relationship with respect to the mounting bridging bars 14.

Figure 11:
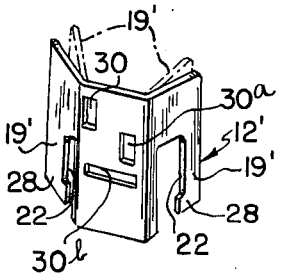
FIG. 11 is an enlarged, perspective view of a modified form of end clip, and showing in phantom lines the distorted condition of the clip for installing the same on its associated T bar grid element.
Figure 12:
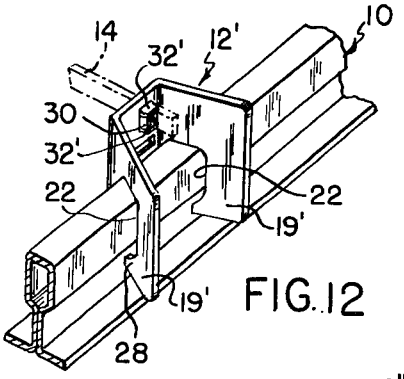
FIG. 12 is a fragmentary, perspective view illustrating the end clip of FIG. 11 as mounted on its respective T bar grid element.

Referring now to FIGS. 11 and 12, there is shown another embodiment of end clip member 12′ which is of a more open U-shaped configuration in plan, with the yieldable arm portions 19′ of the clip 12′ being adapted to be squeezed together as illustrated in phantom lines in FIG. 11, to mount the clip on the associated grid element, after which upon release of the arm portions 19′, they spring outwardly to grip the respective stem of the grid element 10, which is received in the vertical slotted portions 22 of the arms of the clip. The base portion of the U embodies openings **30, 30*a*, 30*b* therein in a similar manner as the first described clip, for mounting an associated bridging bar therein, and as shown for instance in FIG. 12.**

In this embodiment, the material of the clip severed when forming the openings, may provide retainer tabs 32′ on the interior periphery of the respective opening, and are bent diagonally inwardly so that when the bridging bar is inserted through the respective opening, the tabs 32′ grip the bar and prevent its inadvertent withdrawal movement from the clip.

Figure 13:
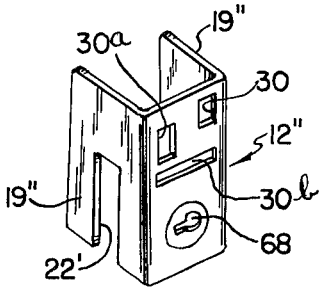
FIG. 13 is a perspective view of a further embodiment of end clip.
Figure 14:
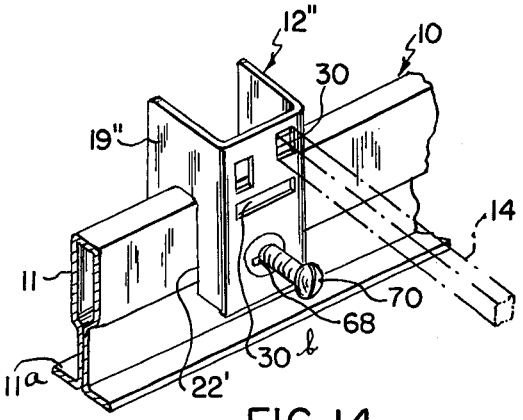
FIG. 14 is a fragmentary, perspective view of the FIG. 13 end clip as mounted on a respective T bar ceiling grid element.

Referring now to FIGS. 13 and 14, there is shown a further embodiment of clip 12″ wherein the base portion of the U-shaped clip is provided with a formed threaded key slot opening 68 therethrough, which is adapted for threaded coaction with a threaded fastener 70 (FIG. 14) for clasping the clip 12″ to the associated grid element 10. In this connection the slots 22′ in the sidewall portions 19″ of the clip are completely vertical so that the clip can be readily pushed or moved downwardly over the stem of the associated grid element, and then the fastener 70 can be tightened to clasp the clip to the respective grid element. A bridging bar 14 or **14*a* is adapted for coaction with the respective selected opening 30, 30*a*, 30*b* in the base portion of the clip (FIG. 14**) for mounting the bridging bar in supported relation between the associated grid elements.

From the following description and accompanying drawings it will be seen that the invention provides a novel fixture support assembly for a grip type ceiling wherein end clips having a plurality of vertically spaced bar support means are provided for mounting a bridging bar therebetween, with the bridging bar being adapted to suspend a fixture, such as an outlet electrical box or some similar element therefrom, and with the bar support means on the clips providing for selective vertical positioning of the bridging bar and associated hanger means with respect to the clips, thereby providing for varying the vertical position of the fixture with respect to the ceiling. The invention also provides an arrangement which facilitates positioning of the fixture lengthwise of the bridging bar or bars and a support assembly which can be utilized for supporting many different types of fixtures and which expedites the mounting of the support assembly and of the fixture on a ceiling, while necessitating the stocking of minimum parts for the fixture supports.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A fixture support for use on a grid type ceiling structure which includes spaced generally parallel grid elements of inverted T-shaped configuration in vertical cross section, comprising one piece clips for mounting in supported relation on the vertical web of respective spaced grid elements, means on said clips for mounting a bridging bar therebetween, a bridging bar for coaction with the last mentioned mounting means and adapted to bridge the associated clips, each of said clips having means for releasably gripping the respective grid element to hold the clip on the respective grid element, said gripping means including a resilient tongue adjacent the lower portion of each clip with the latter being adapted to be forced down over the associated grid element whereby said tongue will grip the vertical web of the respective grid element, and means adapted for coaction with said bar for suspending a fixture therefrom, said last mentioned mounting means providing for varying the vertical position of said bar and thus the vertical position of said suspending means with respect to said clips, and comprising a plurality of vertically spaced openings, a selected one of said vertically spaced openings in each clip adapted to receive a corresponding end of said bridging bar therein for supporting said bridging bar between said associated clips, the ends of the bridging bar being readily insertable into and removable from said selected opening in the respective clip.

2. A support in accordance with claim 1 wherein each said clips includes slot means coacting with said resilient tongue and disposed generally adjacent the lower extremity thereof and comprising said gripping means, said tongue adapted for clasping coaction with the respective grid element received in said slot means for removably retaining the clip to the respective grid element.

3. A support in accordance with claim 1 wherein said clips are formed of sheet metal.

4. A support in accordance with claim 1 wherein each of said clips comprises a sheet metal member of generally U configuration in top plan, and providing a generally vertically oriented surface adapted for facing in the direction of said surface on the opposing clips, each said surface comprising said openings therein providing said last mentioned mounting means.

5. A fixture support for use on a grid type ceiling structure which includes spaced generally parallel, grid elements comprising, clips for mounting on the spaced grid elements, means on said clips for mounting a bridging member therebetween, a bridging member for coaction with said mounting means and adapted to bridge the associated clips, means adapted for coaction with said bridging member for suspending a fixture therefrom, said mounting means providing for varying the vertical position of said bridging member and thus the vertical position of said suspending means with respect to said clips, and wherein each of said clips is of a generally U-shaped configuration in top plan and formed of generally flexible material, the arms of said U configuration having generally vertically extending slots therein commencing adjacent the lower extremities thereof, adapted for receiving therein the respective grid element in resiliently gripped relation, for securing the clips to the respective grid element, and the base of said U comprising a plurality of vertically spaced openings therein comprising said mounting means, the vertical spaced relation of said openings in the respective clip providing for varying the vertical position of said bridging member with respect to said clips, and means on each clip coacting with a respective of said openings for releasably gripping a bridging member inserted therein.

6. A fixture support for use on a grid type ceiling structure which includes spaced generally parallel grid elements of inverted T-shaped configuration in vertical cross section, said support comprising, one piece clips for mounting in supported relation on the vertical web of respective spaced grid elements, and wherein said clips are formed of yieldable sheet material and being of generally U-shaped configuration in plan, the arm portions of said U configuration having vertical slots formed therein which open to the base of the clip and in generally aligned relation with respect to one another for receiving therein a respective grid element, means on said clips for mounting a bridging bar therebetween, a bridging bar coacting with the last mentioned mounting means, means coacting with said bar for suspending a fixture therefrom, said mounting means providing for varying the vertical position of said bar and thus the vertical position of said suspending means with respect to said clips, said mounting means comprising vertically spaced openings in each clip receiving in a selected one of said openings in readily insertable and removable relation the corresponding end of the bridging bar for supporting said bridging bar between said clips, and gripping means coacting with the base of the U configuration including said slots for removably retaining the clips on the respective grid element.

7. A fixture support for use on a grid type ceiling structure which includes spaced generally parallel grid elements of inverted T-shaped configuration in vertical cross section comprising, one piece clips for mounting in supported relation on the vertical web of respective spaced grid elements, means on said clips for mounting a bridging member therebetween, a bridging member for coaction with said mounting means and adapted to bridge the associated clips, each of said clips having means for releasably gripping the respective grid element to hold the clip on the respective grid element, means adapted for coaction with said bridging member for suspending a fixture therefrom, said mounting means providing for varying the vertical position of said bridging member and thus the vertical position of said suspending means with respect to said clips, said mounting means comprising vertically spaced openings in each clip receiving in a selected one of said openings in readily insertable and removable relation the corresponding end of the bridging member for supporting said bridging member between said clips, and wherein said suspending means comprises a generally non-symmetrical U-shape in elevation hanger member having arm portions and a base portion, with a fastener mounted on the base portion adapted to suspend a fixture therefrom, and with the arm portions having openings therein through which is adapted to be received said bridging member, one of said arm portions being diagonally arranged with respect to said base portion and being resiliently movable toward the other arm portion to permit entry of the bridging member through said arm openings, and upon release of said one arm portion, the memory thereof being adapted to move said one arm portion into clasping relation with respect to said bridging member to resist movement of said hanger member lengthwise of said bridging member.

8. A fixture support for a grid type ceiling structure which includes spaced generally parallel grid elements comprising, clips for mounting on the spaced grid elements, each of said clips including means for mounting a bridging member therebetween, a bridging member for coaction with said mounting means, suspending means coacting with said bridging member for suspending a fixture therefrom, said mounting means providing for varying the vertical position of said bridging member and thus the vertical position of said suspending means with respect to said clips, and wherein said suspending means comprises a generally S-shaped hanger member in elevation, with the lower portion of said hanger member including a hook adapted for suspending a fixture therefrom and with the upper portion of said hanger member comprising a resilient arm movable toward the body of said hanger member with openings in said arm and body through which is adapted to extend said bridging member upon squeezing movement of said arm toward said body, and upon release of said arm, the latter being adapted to move automatically back toward its original position to clasp said bridging member and prevent movement of said hanger member lengthwise of said bridging member.

9. In combination a grid type ceiling structure including spaced generally parallel grid elements of inverted T-shaped configuration in cross section, and a fixture support assembly for mounting a fixture on the ceiling comprising, spaced clips mounted on the respective grid elements, means on each clip for mounting an end of a bridging bar therein thereby providing for positioning of the latter between the grid elements, and in bridging relation between respective clips, each clip having means for gripping the respective grid element to hold the clip on the respective grid element, hanger means coacting with the bridging bar for suspending a fixture therefrom, said mounting means including vertically spaced openings in each of the clips adapted to receive therein in supported relation an end of said bridging bar for providing for selectively varying the vertical position of the bridging bar and associated hanger means with respect to the clips, thus providing for adjusting the vertical position of the fixture with respect to the ceiling structure and wherein said hanger means comprises a U-shaped hanger in side elevation, including arm portions relatively movable toward one another, openings in said arm portions receiving the bridging bar therethrough for suspending the hanger on said bridging bar, fastener means coacting with the hanger for securing a fixture thereto, said arm portions being resilient so that they can be forced toward one another to permit entry of said bridging bar through the arm openings, and upon release of the force applied to said arm portions, the latter spring outwardly relative to one another to cause clasping of the bridging bar by the arm portions, and thus retention of the hanger in predetermined position lengthwise relative to said bridging bar.

10. In combination a grid type ceiling structure including spaced generally parallel grid elements of inverted T-shape configuration in cross section, and a fixture support assembly for mounting a fixture on the ceiling comprising, spaced clips removably mounted in supported relation on the vertical web of respective grid elements, means on each clip for mounting an end of a bridging bar therein thereby providing for positioning of the latter between the grid elements and in bridging relation between respective clips, each clip having means providing for gripping the respective grid element to hold the clip on the respective grid element, hanger means coacting with the bridging bar for suspending a fixture therefrom, said mounting means including vertically spaced openings in each of the clips receiving in a selected one of said openings in supported relation an end of said bridging bar for providing for selectively varying the vertical position of the bridging bar and associated hanger means with respect to the clip, thus providing for adjusting the vertical position of the fixture with respect to the ceiling structure, the ends of said bridging bar being readily insertable into and removable from said selected opening in the respective clip.

11. The combination in accordance with claim 10, wherein said vertically spaced openings are staggered in a direction transverse of the clip.

12. The combination in accordance with claim 10, wherein said hanger means comprises clip means secured to a fixture and having bendable tang portions adapted for clasping coaction with a respective bridging bar, for fixing the location of the fixture lengthwise with respect to the bridging bar.

13. The combination in accordance with claim 10 wherein said clips are of generally U-shaped configuration in plan with the arms of the U being resilient for providing said gripping means, said arms each having a slot therein for receiving the respective grid element therein and operative to clasp the grid element for holding the clip to the respective grid element.

14. A clip adapted for mounting one end of an associated fixture supporting bridging member on a grid type ceiling, said clip having means for receiving a grid element of inverted T-shaped configuration in cross section for mounting the clip in supported relation on the vertical web of the grid element, means on said clip coacting with the first mentioned means adapted for releasably clasping the clip to the grid element to hold the clip on the respective grid element, other means on said clip for supporting an end of the bridging member, the last mentioned supporting means including means for selectively varying the vertical position of the bridging member with respect to the clip and comprising a plurality of vertically and laterally spaced openings adapted to receive the corresponding end of the bridging member therein for supporting the bridging member between spaced opposing clips, the ends of the bridging member being readily insertable into and removable from the selected opening in the clip, and wherein said clip is generally vertically elongated having laterally spaced arm portions, said grid element receiving means comprising a slot in each of said arm portions opening to the lower exterior of said clip adapted to receive the grid element therein, said releasable clasping means coacting with said slots and comprising a clasping element disposed generally intermediate the planes of said arm portions.

15. A clip in accordance with claim 14 wherein said clasping means comprises a resilient tongue on the clip adapted for clamping engagement with respect to the grid element received in said first mentioned grid element receiving means.

16. A clip adapted for mounting one end of a fixture supporting bridging member on a grid type ceiling, said clip having means for receiving a grid element for mounting the clip on the grid element, means on said clip coacting with the first mentioned means for releasably clasping the clip to the grid element, other means on said clip for supporting an end of a bridging member, the last mentioned supporting means including means for selectively varying the vertical position of the bridging member with respect to the clip, and wherein said clip is of generally U-shaped configuration in plan with the arm portions of the U configuration having slot means therein comprising said grid element receiving means and extending in the general vertical direction of extension of said clip, the base portion of the U configuration having said last mentioned supporting means for selectively varying the vertical position of the bridging member with respect to the clip, said last mentioned supporting means comprising vertically spaced openings in said base portion.

17. A clip in accordance with claim 16 wherein said clasping means comprises a resilient tongue formed from the material of said clip and extending downwardly and inwardly, said clip adjacent slot means including a foot portion thereon for aiding in resisting removal of the clip from a grid element received in the respective slot means.

18. A clip in accordance with claim 16 wherein said arm portions diverge outwardly away from one another in a direction away from said base portion, said arm portions being adapted for forced movement toward one another to mount the clip on an associated grid element, whereupon the memory of the material from which the clip member is formed causes said arm portions to spring back to their original position upon release thereof, for causing clasping of the grid element received in slot means, the latter arrangement comprising said clasping means.

19. A clip in accordance with claim 16 wherein the clasping means comprises a threaded opening in said base portion receiving therein in threaded relatively movable coaction a threaded fastener means adapted to engage a grid element received in said slot means, for clasping the clip to the grid element.

20. A clip adapted for mounting one end of a fixture supporting bridging member on a grid type ceiling, said clip having means for receiving a grid element for mounting the clip on the grid element, means on said clip coacting with the first mentioned means for releasably clasping the clip to the grid element, other means on said clip for supporting an end of a bridging member, the last mentioned supporting means including means for selectively varying the vertical position of the bridging member with respect to the clip, said clip being of generally U-shaped configuration in plan with the arm portions of the U configuration having slot means therein comprising said grid element receiving means, and extending in the general vertical direction of extension of said clip, said last mentioned supporting means for selectively varying the vertical position of the bridging member with respect to the clip being located on the base portion of the U configuration, and comprising vertically spaced openings in said base portion, and wherein said clip is formed of sheet metal, said openings in said base portion including gripper means coacting with a respective of said openings for gripping the bridging member upon insertion of the latter in the selected opening, for resisting withdrawal of the bridging member from the clip.

* * * * *